United States Patent [19]

Diotte

[11] Patent Number: 4,973,285

[45] Date of Patent: Nov. 27, 1990

[54] SIMULATED CAR PHONE

[76] Inventor: Manuel A. Diotte, 8248 Marbach Rd., San Antonio, Tex. 78227

[21] Appl. No.: 417,435

[22] Filed: Oct. 5, 1989

[51] Int. Cl.[5] ..... A63H 33/30

[52] U.S. Cl. ..... 446/142; 272/8 N

[58] Field of Search ..... 446/142, 141, 397; 272/8 N, 8 R

[56] References Cited

U.S. PATENT DOCUMENTS

| | | |
|---|---|---|
| 3,382,604 | 5/1968 | Ryan . |
| 3,594,941 | 7/1971 | Handler et al. . |
| 4,103,452 | 8/1978 | Wood . |
| 4,104,821 | 8/1978 | Nakajima . |
| 4,713,035 | 12/1987 | Thom . |

FOREIGN PATENT DOCUMENTS 3710135 10/1988 Fed. Rep. of Germany ..... 446/142

*Primary Examiner*—Mickey Yu

*Attorney, Agent, or Firm*—Jerry T. Kearns

[57] ABSTRACT

A simulated car phone includes a handset unit configured to resemble an operational car phone. The handset unit includes a simulated keypad and a simulated signal cord. A radio frequency receiver is provided in the handset for receiving signals from a small remote battery powered unit radio frequency transmitter. A battery powered audio tape player in the handset unit produces simulated telephone ring signals through an audio speaker. The audio tape player is actuated by switching circuitry in the handset unit on reception of radio signals produced by manual actuation of the remote transmitter. The device provides an amusing and inexpensive novelty item which may be used in conjunction with simulated car phone antennas to amuse and impress an individual's friends and acquaintances.

10 Claims, 3 Drawing Sheets

SIMULATED CAR PHONE

BACKGROUND OF THE INVENTION

1. Field of the Invention

The present invention relates to simulated phones, and more particularly pertains to a simulated car phone which includes audible simulated ring signal producing circuitry to provide an amusing and inexpensive simulation of a car telephone.

2. Description of the Prior Art

Various types of simulated phones are known in the prior art. A typical example of such a simulated phone is to be found in U.S. Pat. 3,382,604, which issued to J. Ryan on May 14, 1968. This patent discloses a toy phonographic telephone having a housing simulating a real telephone. A battery-operated turntable rotates a record carrying suitable messages reproduced by a tone am carrying a needle. Push button switches actuate and deactuate the turntable upon lifting and replacing a simulated handset. U.S. Pat. 3,594,941, which issued to E. Handler et al on July 27, 1971, discloses a toy telephone with a spring powered phonograph in the telephone base that is operated by a drawstring. The drawstring is attached to the telephone handset, in the manner of a telephone cord, such that the phonograph is actuated by pulling the handset away from the base and then releasing it. U.S. Pat. 4,103,452, which issued to R. Wood on Aug. 1, 1978, discloses a toy telephone which is selectively connectible to home stereo systems. The telephone is a talking toy which utilizes a stereo sound system requiring a playback on two separate speakers. One of the speakers is mounted on the base of the telephone and the other speaker is enclosed within a receiver portion of the handset. An external tape or record includes two stereophonic channels for producing a telephone ring through the base speaker and a verbal message through the handset speaker. U.S. Pat. 4,104,821, which issued to T. Nakajima on Aug. 8, 1978, discloses a battery powered toy telephone capable of playing in random order any one of several recorded messages and also capable of intermittent ringing of a bell. U.S. Pat. 4,713,035, which issued to P. Thom on Dec. 15, 1987, discloses a toy telephone having a base, a dial connected to the base and noise generating means within the base actuated by the dial.

While the above mentioned devices are directed to simulated phones, none of these devices disclose a simulated car phone including a battery powered audio tape player actuatable by a remote radio frequency transmitter to produce a simulated telephone ring signal. Inasmuch as the art is relatively crowded with respect to these various types of simulated phones, it can be appreciated that there is a continuing need for and interest in improvements to such simulated phones, and in this respect, the present invention addresses this need and interest.

SUMMARY OF THE INVENTION

In view of the foregoing disadvantages inherent in the known types of simulated phones now present in the prior art, the present invention provides an improved simulated car phone. As such, the general purpose of the present invention, which will be described subsequently in greater detail, is to provide a new and improved simulated car phone which has all the advantages of the prior art simulated phones and none of the disadvantages.

To attain this, a representative embodiment of the concepts of the present invention is illustrated in the drawings and makes use of a simulated car phone which includes a handset unit configured to resemble an operational car phone. The handset unit includes a simulated keypad and a simulated signal cord. A radio frequency receiver is provided in the handset for receiving signals from a small remote battery powered unit radio frequency transmitter. A battery powered audio tape player in the handset unit produces simulated telephone ring signals through an audio speaker. The audio tape player is actuated by switching circuitry in the handset unit on reception of radio signals produced by manual actuation of the remote transmitter. The device provides an amusing and inexpensive novelty item which may be used in conjunction with simulated car phone antennas to amuse and impress an individual's friends and acquaintances.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the public generally, and especially those who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved simulated car phone which has all the advantages of the prior art simulated phones and none of the disadvantages.

It is another object of the present invention to provide a new and improved simulated car phone which may be easily and efficiently manufactured and marketed.

It is a further object of the present invention to provide a new and improved simulated car phone which is of a durable and reliable construction.

An even further object of the present invention is to provide a new and improved simulated car phone which is susceptible of a low cost of manufacture with regard to both materials and labor, and which accordingly is then susceptible of low prices of sale to the consuming public, thereby making such simulated phones economically available to the buying public.

Still yet another object of the present invention is to provide a new and improved simulated car phone which provides in the apparatuses and methods of the prior art some of the advantages thereof, while simultaneously overcoming some of the disadvantages normally associated therewith.

Still another object of the present invention is to provide a new and improved simulated car phone which provides an inexpensive amusing device.

Yet another object of the present invention is to provide a new and improved simulated car phone capable of producing an audible telephone ring signal in response to actuation of a remote hidden radio frequency transmitter.

Even still another object of the present invention is to provide a new and improved simulated car phone including a battery powered audio tape player operative to produce simulated telephone ring signals in response to manual actuation of a small remote radio frequency transmitter.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
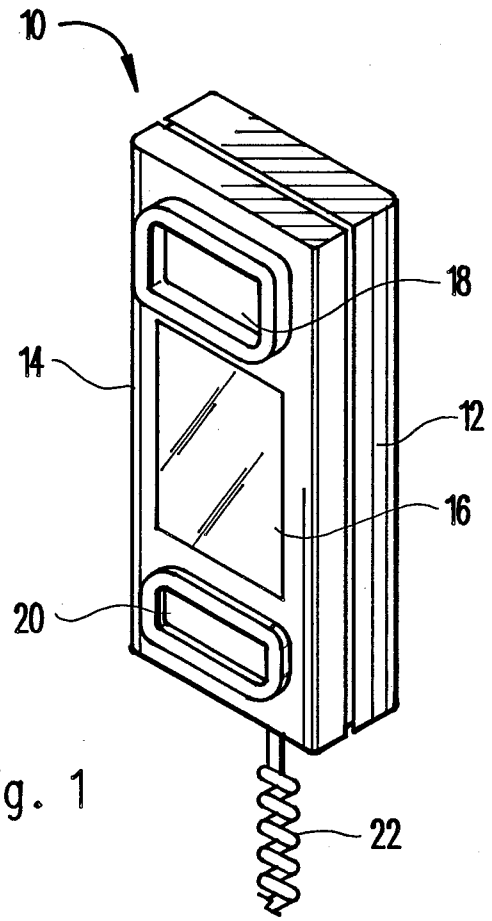
FIG. 1 is a back side perspective view of the simulated car phone of the present invention.

With reference now to the drawings, and in particular to FIG. 1 thereof, a new and improved simulated car phone embodying the principles and concepts of the present invention and generally designated by the reference numeral 10 will be described.

More specifically, it will be noted that the first embodiment 10 of the invention includes a generally rectangular housing 12 including a simulated earpiece 18 and a simulated mouthpiece 20. A tinted translucent door 16 of a conventional audio tape player is disposed on the back face of the housing 12, between the simulated earpiece 18 and simulated mouthpiece 20. A simulated signal cord 22 extends from the housing 12. The audio tape player within the housing 12 may be of a conventional micro-cassette or standard cassette type.

Figure 2:
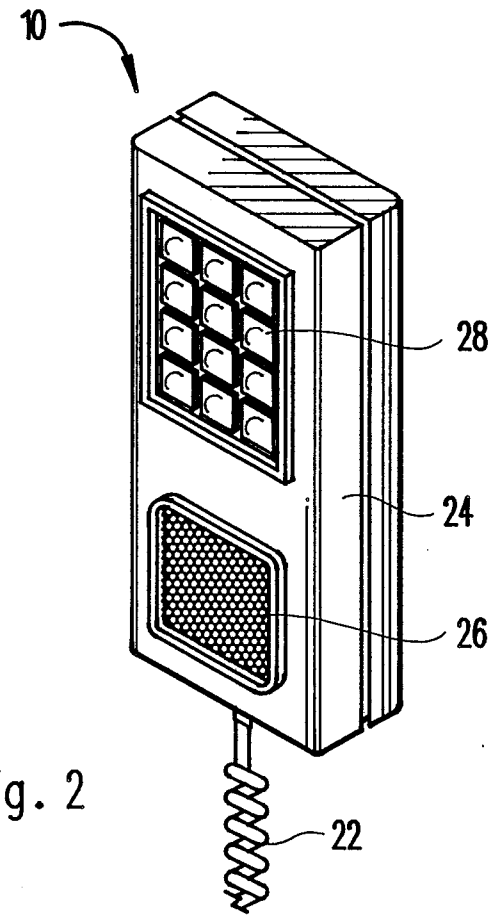
FIG. 2 is a front side perspective view of the simulated car phone of the present invention.

As illustrated in the front side perspective view of FIG. 2, the handset car phone unit 10 includes a simulated numeric keypad 28 and an audio speaker 26. The front face 24 of the handset unit 10 is configured to resemble a conventional operational cellular type car phone.

Figure 3:
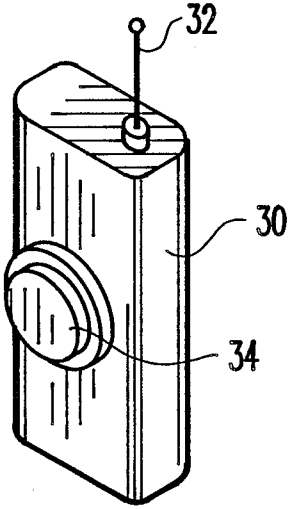
FIG. 3 is a perspective view illustrating a remote radio frequency transmitter for actuating the simulated car phone of the present invention.

FIG. 3 is a perspective view illustrating a remote radio frequency transmitter 30 which include an antenna 32 and a push button actuator 34. The transmitter 30 may be of the type utilized to produce a digital coded signal of the type utilized in garage door openers. The transmitter 30 is preferably of a small size so as to be easily concealable from vehicle occupants.

Figure 4:
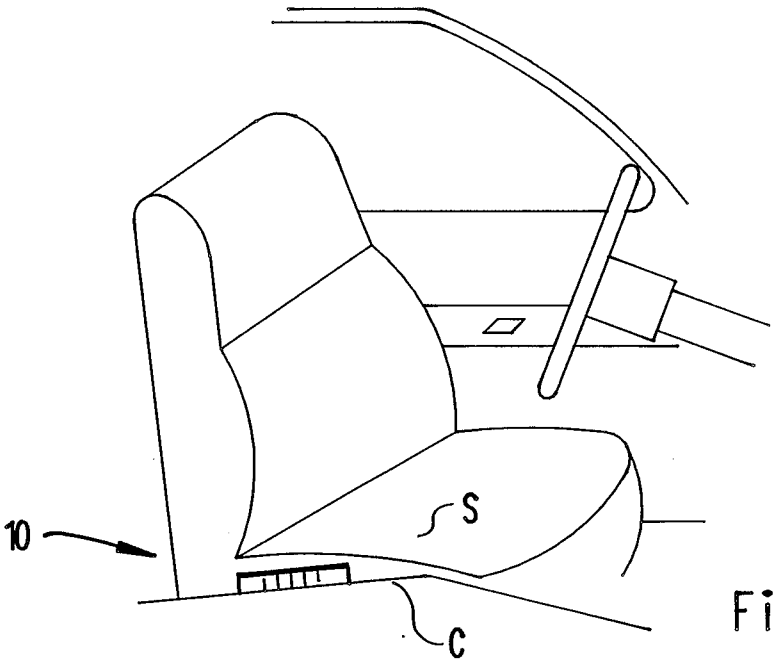
FIG. 4 illustrates the simulated car phone of the present invention mounted within a conventional vehicle.

FIG. 4 illustrates a typical mounting of the handset unit 10 on a central consul C within a conventional vehicle. The handset unit 10 is disposed adjacent the driver seat S for convenient access.

Figure 5:
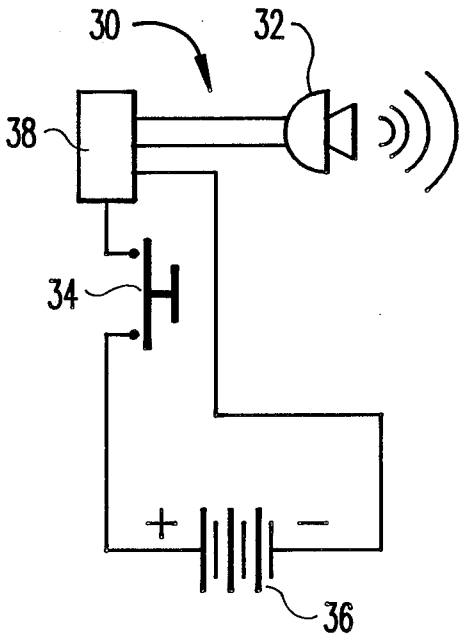
FIG. 5 is a schematic diagram illustrating the electrical components of the remote radio frequency transmitter of FIG. 3.

FIG. 5 illustrates a schematic diagram of the remote radio frequency transmitter 30. An internal battery 36 is connectable by a push button switch 34 to a digital coded frequency producing unit 38 operative to actuate a broadcast antenna 32. The transmitter unit 30 may be of the low powered type so as to have an effective broadcast radius of approximately twenty feet. This low power construction prevents interference with other radio frequency receivers.

Figure 6:
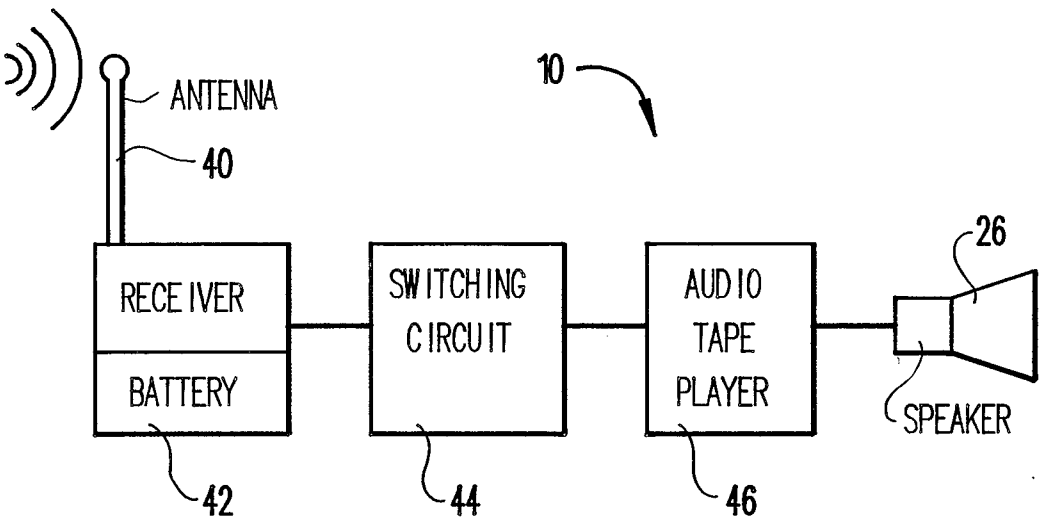
FIG. 6 is a schematic diagram illustrating the electrical components of the simulated car phone of the present invention.

FIG. 6 illustrates the electrical components of the handset unit 10. An antenna 40, preferably of an invisible hidden type, is operative to receive radio frequency signals from the remote transmitter 30. A battery powered receiver 42 provides suitably amplified signals to a switching circuit 44. The switching circuit 44 may be of a conventional solid state type, or may include relay switching. The switching circuit 44, is operative to actuate an audio tape player 46. The audio tape player 46 is preferably of the micro-cassette type utilized in conventional telephone answering machines, and includes an audio cassette upon which a simulated telephone ring signal is recorded. Additionally, a simulated verbal telephone message may also be provided, subsequently to the telephone ring signal. An audio speaker 26 is operative to broadcast an audible telephone ring signal upon manual actuation of the remote transmitter 30.

As may now be understood, an individual may hide the remote transmitting unit and selectively depress the push button 34 to produce a simulated telephone ring signal on the handset unit 10. This allows an individual to entertain and amuse friends, as well as providing a status symbol without requiring the purchase of an expensive cellular telephone. The simulated car phone of the present invention may be combined with simulated externally mounted cellular phone antennas to provide a more realistic effect.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by letters patent of the United States is as follows:

1. A simulated car phone, comprising:

a handset unit configured to resemble an operational car phone;

a small remote battery powered radio frequency transmitter;

a radio frequency receiver in said handset unit for receiving signals from said remote transmitter;

a battery powered audio tape player in said handset unit for producing simulated telephone ring signals;

a speaker in said handset unit operatively connected to said audio tape player;

and a switching circuit in said handset unit for actuating said audio tape player in response to manual actuation of said remote transmitter.

2. A simulated car phone, comprising:

a handset unit configured to resemble an operational car phone;

an audio tape player and speaker in said handset unit for producing a telephone ring signal;

and a remote unit for selectively actuating said audio tape player.

3. The simulated car phone of claim 2, further comprising switching circuitry in said handset unit operative to actuate said audio tape player in response to manual actuation of said remote unit.

4. The simulated car phone of claim 3, wherein said remote unit comprises a radio frequency transmitter.

5. The simulated car phone of claim 4, further comprising a radio frequency receiver in said handset unit.

6. The simulated car phone of claim 2, further comprising a simulated keypad on said handset unit.

7. The simulated car phone of claim 2, further comprising a simulated signal cord connected to said handset unit.

8. A simulated car phone, comprising:

a handset unit configured to resemble an operational car phone;

audio means in said handset unit for producing a telephone ring signal;

a radio frequency receiver in said handset unit operably connected to said audio means;

and a remote radio frequency transmitter for selectively actuating said audio means.

9. The simulated car phone of claim 8, further comprising a simulated keypad on said handset unit.

10. The simulated car phone of claim 8, further comprising a simulated signal cord connected to said handset unit.

* * * * *